US006611968B1

(12) United States Patent
Swanson et al.

(10) Patent No.: US 6,611,968 B1
(45) Date of Patent: Sep. 2, 2003

(54) WATER BODY (E.G., POOL) WATER LEVEL REPLENISHMENT SYSTEM AND METHOD

(76) Inventors: Paul Swanson, 800 W. El Camino Real #180, Mountain View, CA (US) 94040; Brett Thomas, 14576 Debell Rd., Los Altos, CA (US) 94022

( * ) Notice: Subject to any disclaimer, the term of this patent is extended or adjusted under 35 U.S.C. 154(b) by 0 days.

(21) Appl. No.: 10/191,755

(22) Filed: Jul. 10, 2002

(51) Int. Cl.[7] ..... E04H 4/14
(52) U.S. Cl. ..... 4/508; 4/496; 239/20
(58) Field of Search ..... 4/496, 507, 508; 239/17, 20; 472/128

(56) References Cited

U.S. PATENT DOCUMENTS

| | | | | |
|---|---|---|---|---|
| 3,139,628 A | | 7/1964 | Richards | |
| 3,178,116 A | | 4/1965 | Cucuzza et al. | |
| 3,318,528 A | | 5/1967 | Williams | |
| 3,722,816 A | | 3/1973 | Stewart | |
| 3,831,852 A | | 8/1974 | Stillman, Jr. | |
| 4,485,802 A | * | 12/1984 | Babcock | 4/507 X |
| 4,489,565 A | * | 12/1984 | Taylor | 62/59 |
| 4,920,465 A | | 4/1990 | Sargent | |
| 4,955,540 A | * | 9/1990 | Fuller et al. | 239/20 |
| 5,078,320 A | | 1/1992 | Fuller et al. | |
| 5,203,038 A | | 4/1993 | Gibbs | |
| 5,217,161 A | | 6/1993 | Souza | |
| 5,505,380 A | | 4/1996 | Jun | |
| 5,820,022 A | * | 10/1998 | Fukano et al. | 239/17 |
| 5,933,883 A | | 8/1999 | Biancamano | |
| 6,081,944 A | * | 7/2000 | Edwards | 4/496 |
| 6,156,026 A | | 12/2000 | Rondeau | |
| 6,158,064 A | | 12/2000 | Downs | |
| 6,216,286 B1 | | 4/2001 | Zankow | |
| 6,223,359 B1 | | 5/2001 | Oltmanns et al. | |
| 6,269,491 B2 | | 8/2001 | Zankow | |
| 6,276,200 B1 | | 8/2001 | Cazden | |
| 6,283,139 B1 | | 9/2001 | Symonds et al. | |

* cited by examiner

*Primary Examiner*—Robert M. Fetsuga
(74) *Attorney, Agent, or Firm*—Stephen B. Parker, Esq.; Rothwell, Figg, Ernst & Manbeck, p.c.

(57) ABSTRACT

The preferred embodiments relate to a system for replenishing water (e.g., due to evaporation, leakage, etc.) in a body of water (e.g., a pool, pond, etc.) via a discharge unit displaced from the body of water. The discharge unit is preferably laterally displaced. Preferably, a timer mechanism is provided to adjust the amount of water discharged into the body of water. In preferred embodiments, the discharge unit is configured in the shape of a natural object, such as a animal native to the locality (e.g., frog, turtle, rabbit, etc.), a non-native animal (e.g., a dolphin, whale, seal, bear, etc.), a natural or unnatural object or the like.

54 Claims, 6 Drawing Sheets

WATER BODY (E.G., POOL) WATER LEVEL REPLENISHMENT SYSTEM AND METHOD

FIELD OF THE INVENTION

The present application relates to methods for replenishing water in bodies of water, such as pools, ponds, baths, fountains, reflecting ponds, Jacuzzis, water tanks and other bodies of bodies. The most preferred embodiments of the invention relate to methods for replenishing water in swimming and/or wading pools used for human activities, such as swimming, relaxing, bathing and the like. The most preferred embodiments relate to methods for replenishing water in outdoor pools and other outdoor bodies of water (e.g., pools that are not located within building structures), but various embodiments apply to indoor pools and other indoor bodies of water.

INTRODUCTION

Historically, the water level in bodies of water, such as swimming pools, wading pools and ponds, whether indoor or outdoor, may vary over time due to a variety of environmental factors. Some factors that may result in water depletion can include: evaporation; water leakage (e.g., through a foundation containing the body of water); and/or other depletion means (e.g., splashing, withdrawing water for other systems, etc.).

In the context of swimming pools, owners often need to replenish water in such pools over time. Most notably, water in swimming pools tends to evaporate and owners need to replenish water that is lost over time due to evaporation and/or the like. Often, pool owners simply take a hose, such as a garden house, and run the hose from a supply source (e.g., a water spigot attached to a building or the like) over to the pool. In many cases, such a hose can create a hazard adjacent a pool since, e.g., users may trip over such hoses. Additionally, placement of such hoses over the side edges of pools is typically not aesthetically pleasing.

There remains a need for a system and method to effectively replenish water in bodies of water, such as, e.g., in swimming pools, wading pools, ponds, Jacuzzis, fountains, reflecting ponds, and a variety of other bodies of water, which overcomes limitations in existing systems and methods. The embodiments of the present invention provide unique qualities and characteristics not even remotely contemplated in existing devices, such as, e.g., in any of the following patents: U.S. Pat. No. 3,139,628 (Richards); U.S. Pat. No. 3,178,116 (Cucuzza, et al.); U.S. Pat. No. 3,318,528 (Williams); U.S. Pat. No. 3,722,816 (Stewart, et al.); U.S. Pat. No. 3,831,852 (Stillman, Jr.); U.S. Pat. No. 4,920,465 (Sargent); U.S. Pat. No. 5,078,320 (Fuller, et al.); U.S. Pat. No. 5,203,038 (Gibbs); U.S. Pat. No. 5,217,161 (Souza); U.S. Pat. No. 5,505,380 (Jun); U.S. Pat. No. 5,933,883 (Biancamano); U.S. Pat. No. 6,156,026 (Rondeau); U.S. Pat. No. 6,158,064 (Downs); U.S. Pat. No. 6,216,286 B1 (Zankow); U.S. Pat. No. 6,233,359 B1 (Oltmanns, et al.); U.S. Pat. No. 6,269,491 (Zankow); U.S. Pat. No. 6,276,200 B1 (Cazden); and/or U.S. Pat. No. 6,283,139 B1 (Symonds, et al.).

SUMMARY OF THE PREFERRED EMBODIMENTS

The preferred embodiments of the invention provide a system and/or method that overcomes various limitations in existing systems and devices. The preferred embodiments of the invention can be used, e.g., to replenish water in various bodies of water, such as pools, ponds, baths, fountains, reflecting ponds, Jacuzzis, water tanks and other bodies of bodies.

According to a first embodiment, a method for maintaining a generally consistent level of water in a depleting body of water is provided that includes: a) providing a depleting body of water; b) providing a discharge unit laterally displaced from said depleting body of water; c) providing said discharge unit with a water inlet and a water outlet; d) providing a water conduit extending to said water inlet from a supply source of water; f) positioning said water outlet so as to transmit water in an above-ground trajectory laterally into said depleting body of water; g) determining a water depletion amount; h) establishing a water flow through said discharge device and out of said water outlet in said above-ground trajectory into said body of water based on the water depletion amount determined. In some preferred embodiments, the body of water is a swimming or wading pool for humans. In some embodiments, the pool is an above ground pool and in others it is an in-ground pool. In some embodiments, the outlet of said discharge unit is laterally displaced at least about two feet from said body of water, or preferably, at least about four feet from said body of water, or preferably, at least about eight feet from said body of water, or preferably, at least about ten feet from said body of water. In some embodiments, the discharge unit discharges water through said outlet at an inclination of between horizontal (90 degrees) and vertical (zero degrees), and preferably, at an inclination of between about 15 degrees and 75 degrees, and preferably, said discharge outlet is adjustable via an adjustment mechanism.

In preferred embodiments, the discharge unit is configured in the shape of an animal, such as a frog, and wherein said water outlet is located in a mouth region of the frog.

In preferred embodiments, the determining water depletion amount includes determining water evaporation amount.

According to another embodiment of the invention, a system for replenishing water depleted from a body of water is provided that includes: a) a depleting body of water; b) a discharge unit laterally displaced from said depleting body of water; c) said discharge unit having a water inlet and a water outlet; d) a supply source of water; e) a water conduit extending to said water inlet from said supply source of water; f) said water outlet being positioned so as to transmit water in an above-ground trajectory laterally into said depleting body of water; g) means for determining water depletion amount; h) a valve for establishing water flow through said discharge device and out of said water outlet in said above-ground trajectory into said body of water at a rate corresponding to water depletion in the body of water.

Various other embodiments, advantages and/or benefits of various embodiments of the present invention will be appreciated based on the present disclosure. It is contemplated that various embodiments will include and/or exclude different aspects, advantages and/or benefits and that descriptions of aspects, advantages and/or benefits of the various embodiments should not be construed as limiting other embodiments nor the inventions claimed.

BRIEF DESCRIPTION OF THE DRAWINGS

The attached figures are shown by way of example and not limitation, in which.

DETAILED DESCRIPTION OF THE PREFERRED EMBODIMENTS

Figure 1:
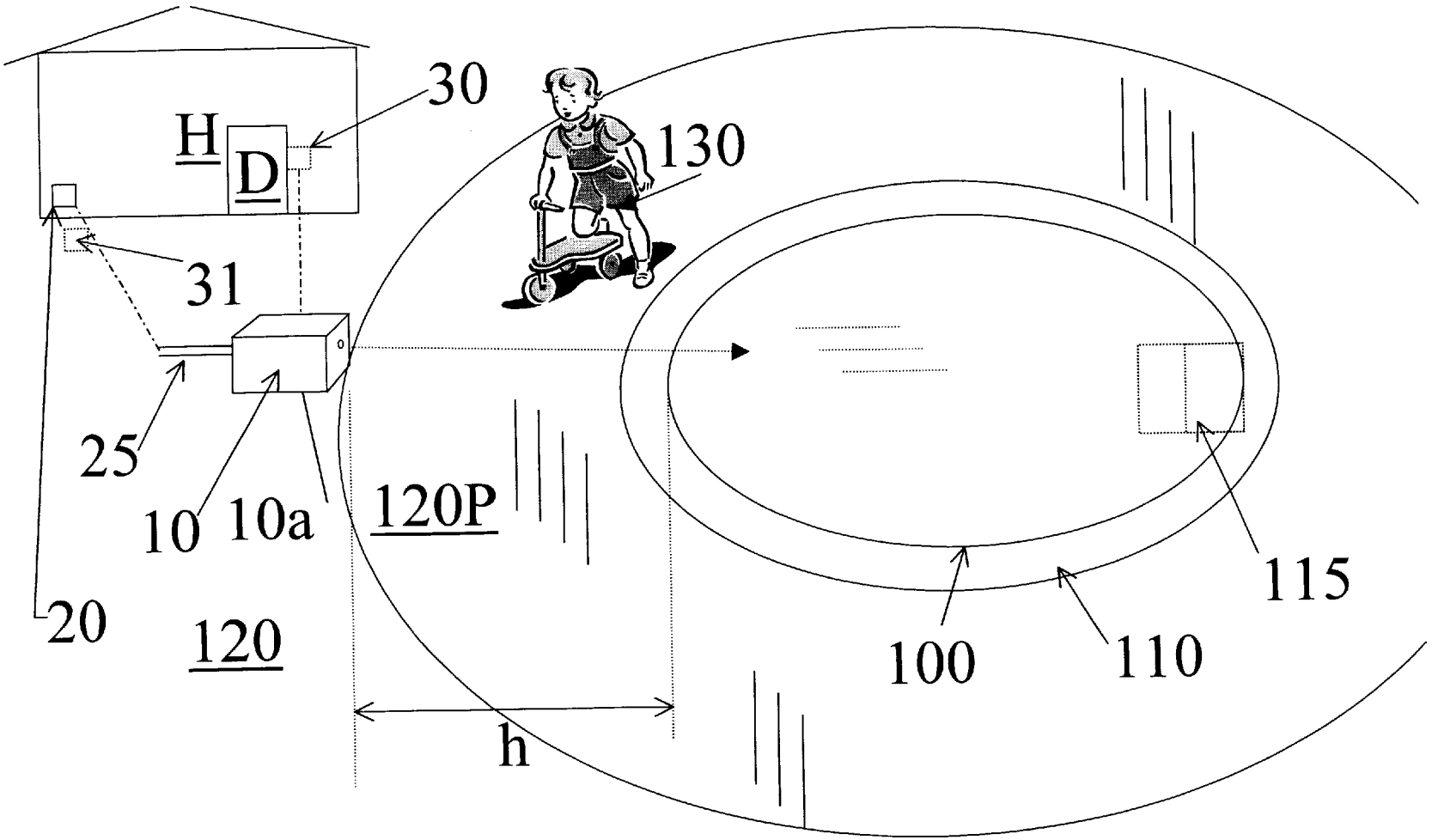
FIG. 1 is a schematic perspective view diagram showing some illustrative embodiments of the invention.

FIG. 1 shows illustrative embodiments of the invention wherein a discharge unit 10 is located proximate a body of water 100. In the illustrative embodiment, the discharge unit 10 is preferably located on a ground surface 120 and the body of water is preferably an in-ground or partially above ground pool having a peripheral wall 110 (e.g., made of concrete or the like) having an upper end that is generally proximate the level of the ground surface (e.g., within about one foot of the ground surface, or more preferably within about 6 inches of the ground surface, or more preferably within about 3 inches of the ground surface).

In the illustrative embodiment shown in FIG. 1, the body of water 100 is a swimming and/or wadding pool. In the illustrated embodiment, the swimming pool includes stairs or a ladder 115 to facilitate user entry and/or egress into and/or from the pool.

In the illustrative embodiment, the pool includes a patio area 120P substantially at ground level surrounding the pool. The patio area is preferably constructed with concrete; slate; brick tiles; and/or other well known pool vicinity flooring materials.

Preferably, the discharge unit 10 is laterally displaced from a perimeter side edge of the body of water 100 by a distance h. Preferably, the discharge unit 10 is set back a sufficient distance to enable users to freely walk between the discharge unit 10 and the body of water. Among other things, the provision of an open area between the discharge unit and the body of water can facilitate and/or enable users 130 (such as, e.g., adults, children or the like) to pass there-through without risk of impingement upon a hose, conduit or the like which could result in hazards adjacent a body of water (e.g., falling upon concrete or the like patio surfaces and/or falling into the body of water). Among other things, the use of a displacement distance h can also facilitate the maintenance of the unit 10 in some instances, such as enabling maintenance without necessarily being at or proximate the body of water in some embodiments. In some instances, the discharge unit 10 could even be located outside of a locked gate (not shown) within a fence (not shown) that surrounds the pool. In that manner, the discharge unit could be attended to with reduced risks of pool related injuries. In some instances, the discharge unit 10 can advantageously be placed within a landscaped region, e.g., a garden area, near the body of water or pool (e.g., upon soil, within bushes, within flowers and/or plants).

As shown, the discharge unit preferably includes an inlet into which a hose or conduit 25 can be attached. Preferably, a common garden hose can be used for the hose or conduit 25. Preferably, the hose or conduit 25 is attachable to a water-dispensing spigot 20 (e.g., via a common threaded garden-hose connection or via any other known connection means). In some illustrative embodiments, the spigot may be located, for example, alongside an external wall of a building H (e.g., a residence, pool house or any other structure).

Preferably, the conduit 25 can be attached to the spigot 20 and/or to another external water source so as to provide a source of water to be discharged via the discharge unit 10. Preferably, opening of the spigot 20 causes water to be driven into the conduit 25 under pressure (e.g., as with a common commercial and/or house-hold water spigot). In preferred embodiments, in order to prevent water from freely passing through the discharge unit upon opening the spigot 20, a valve is provided that regulates passage of water through the discharge unit 10. The valve can be located, e.g., at any position between the spigot 20 and the outlet of the discharge unit 10. Preferably, however, the discharge unit houses such a valve.

In preferred embodiments, a mechanism is provided that can selectively open and/or close the valve so as to cause water to freely flow through the discharge unit (e.g., to discharge) and/or to stop flowing there-through.

In some embodiments, the mechanism can include a timer mechanism that is settable to cause the valve to open and/or close (e.g., via a solenoid, an electric motor and/or another mechanism). In some embodiments, the mechanism for opening and/or closing the valve can be battery operated and/or can be connected to another electric or other power source. In some illustrative embodiments, the timer can include an alpha-numeric key pad (not shown), a rotary dial (not shown) and/or the like in which a user enters a start time and an end time during which the valve will be opened and/or closed on a periodic basis (e.g., weekly, daily, hourly or the like).

Figure 6:
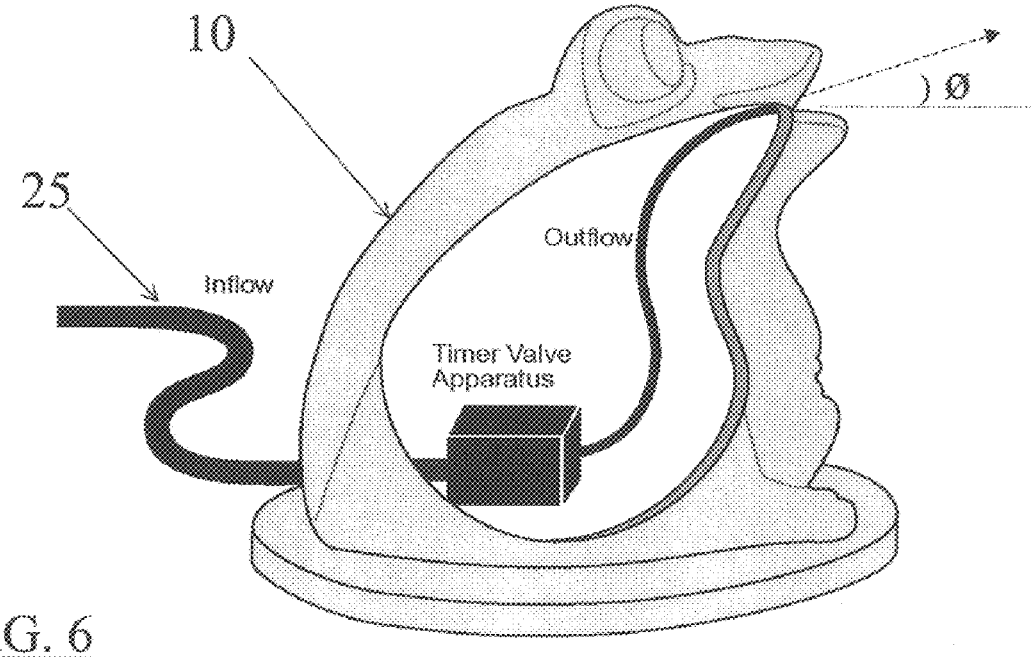
FIG. 6 is a broken-away side view of a discharge unit according to some preferred embodiments of the invention.

In some preferred embodiments, as shown in FIG. 6, both the valve and the timer may be contained inside the discharge unit 10. In some embodiments, the discharge unit 10 can include an open and/or openable base to access the timer and valve mechanisms.

In some embodiments, as shown in FIG. 1, a timer mechanism 30 and/or a user interface thereof can be separated from the discharge unit to facilitate operation in some circumstances. For instance, as shown, in some embodiments a timer mechanism 30 can be located, e.g., proximate the door D of a building H. In some embodiments, the timer mechanism 30 may include a data entry device (e.g., a key pad) along with a processing unit, data storage, memory and a transmitter. Then, data entered into the timer may be used to send a signal to a respective receiver associated with the valve mechanism to cause the valve to open and/or close. In some embodiments, the signal may be transmitted remotely (e.g., using electromagnetic waves or the like). In some embodiments, the timer mechanism can be located within the discharge unit 10, but can be remotely operated via a hand-held portable mechanism.

In alternate embodiments, a timer device and/or valve device 31 can be located at another location along the hose or conduit 25, such as at the juncture to the spigot 20. In these embodiments, for example, the valve can be programmed and/or controlled via a device 31. In some embodiments, the device 31 could have a valve incorporated therein, while in other embodiments, the valve could be located in the discharge unit or the like.

In alternate embodiments, the device 30 can be a hand-held remote control device that can operate the timer from a distance, using technology similar to that used in a common television remote control device to send signals to the timer for programming. The device 30 and/or the device 31 in these respective embodiments may be battery operated and/or otherwise powered.

In some embodiments, the valve mechanism can be adjusted (e.g.. altered) so as to alter the volume flow rate of water there-through. For example, in some embodiments a size of a discharge opening can be preset such that upon opening of the valve a predetermined flow rate of water will be discharged.

In some preferred embodiments, a volume flow rate meter device (not shown) can be provided (e.g., within the discharge unit 10 or the like) that can tabulate the volume of water discharged for a given period of time. In that manner, a user can more readily evaluate the level of water flow required and/or actually set.

In some illustrative embodiments, a user may observe the depletion rate in the volume of water in the body of water 100 (e.g., by calculating a depth of water loss for a given time period, such as for a week of time, or for a day of time or the like). Then, the user can select a particular setting of the timer to best accommodate such a depletion rate. In some embodiments, a chart can be provided (e.g., packaged along with the sale of the system) that identifies recommended settings. In some embodiments, such recommendations may take into consideration, e.g., pool size, surface area of a pool, geographical area, average humidity, average temperature and/or other factors. Then, a user may later adjust the rate or amount of flow (e.g., the duration of opening of the Valve) per unit time based on results actually obtained after initial implementation of the recommended setting.

In some embodiments, the discharge unit has a base 10*a* that rests at a level substantially equal to a top of a perimeter wall around the body of water over which water discharged from the discharge unit is discharged. In some embodiments, the body of water is a swimming pool having a maximum depth of at least four feet deep. In some embodiments, the swimming pool has a maximum depth of at least nine feet deep.

Figure 2:
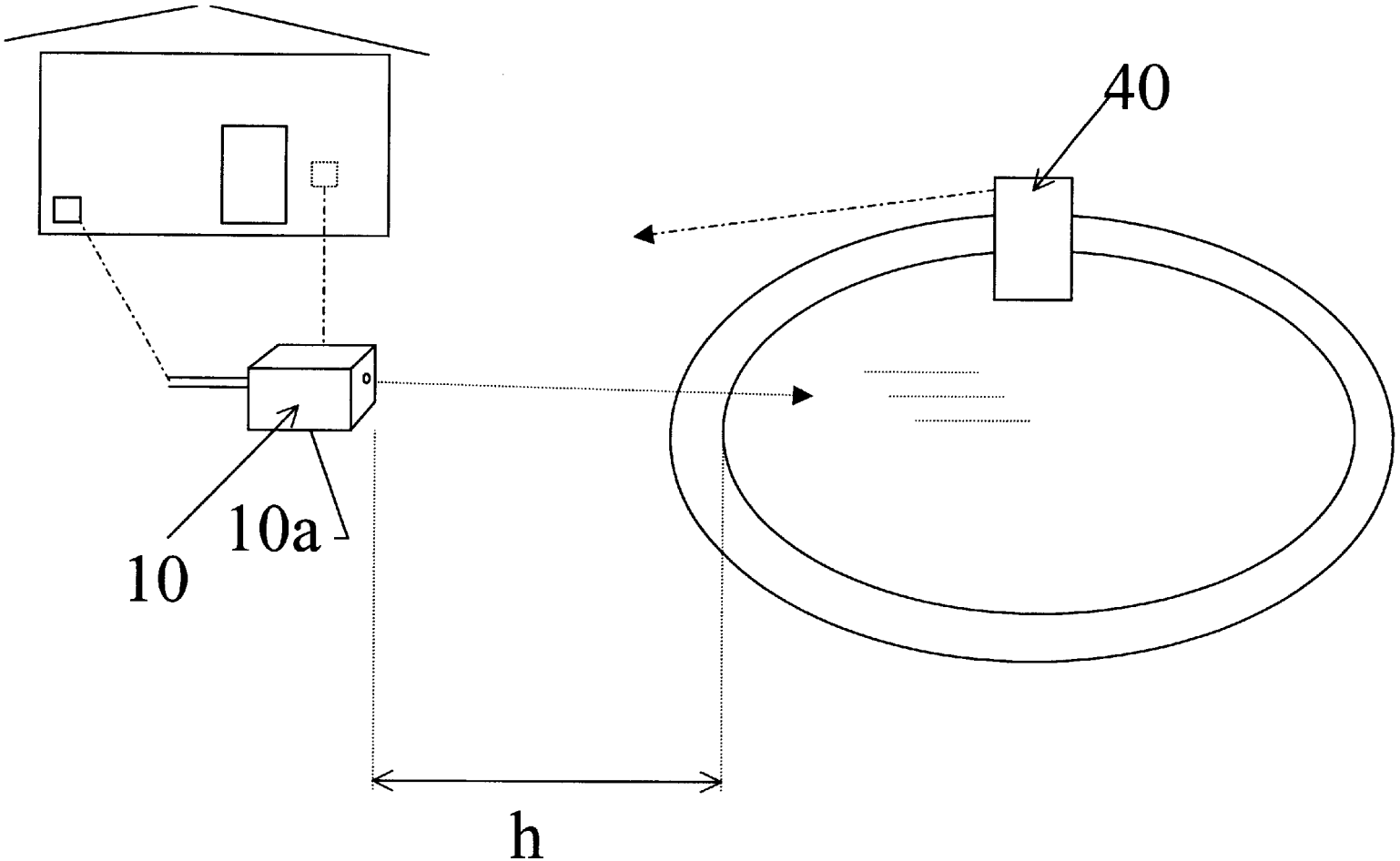
FIG. 2 is another schematic perspective view diagram showing some illustrative embodiments of the invention.

FIG. 2 illustrates an embodiment wherein a water level sensing device is provided which provides direct readings for controlling a timer and/or valve mechanism. In some embodiments, for example, a timer can be omitted and the valve can be set to remain open as long as the water level is below a predetermined level. Alternately, a sensed drop in water level can be used to send a signal to the timer so as to effect opening and closing of the valve via the timer. Preferably, the sensor 40 sends a signal via wireless remote means (e.g., electromagnetic signal). However, the system could alternatively be hardwired. The sensor 40 can include, for example, a float mechanism, a chemical sensor (e.g., reacting to water constituents in the body of water, e.g., conductivity, chemistry, etc.) or any other means to determine the level of the water in the body of water.

Figure 3:
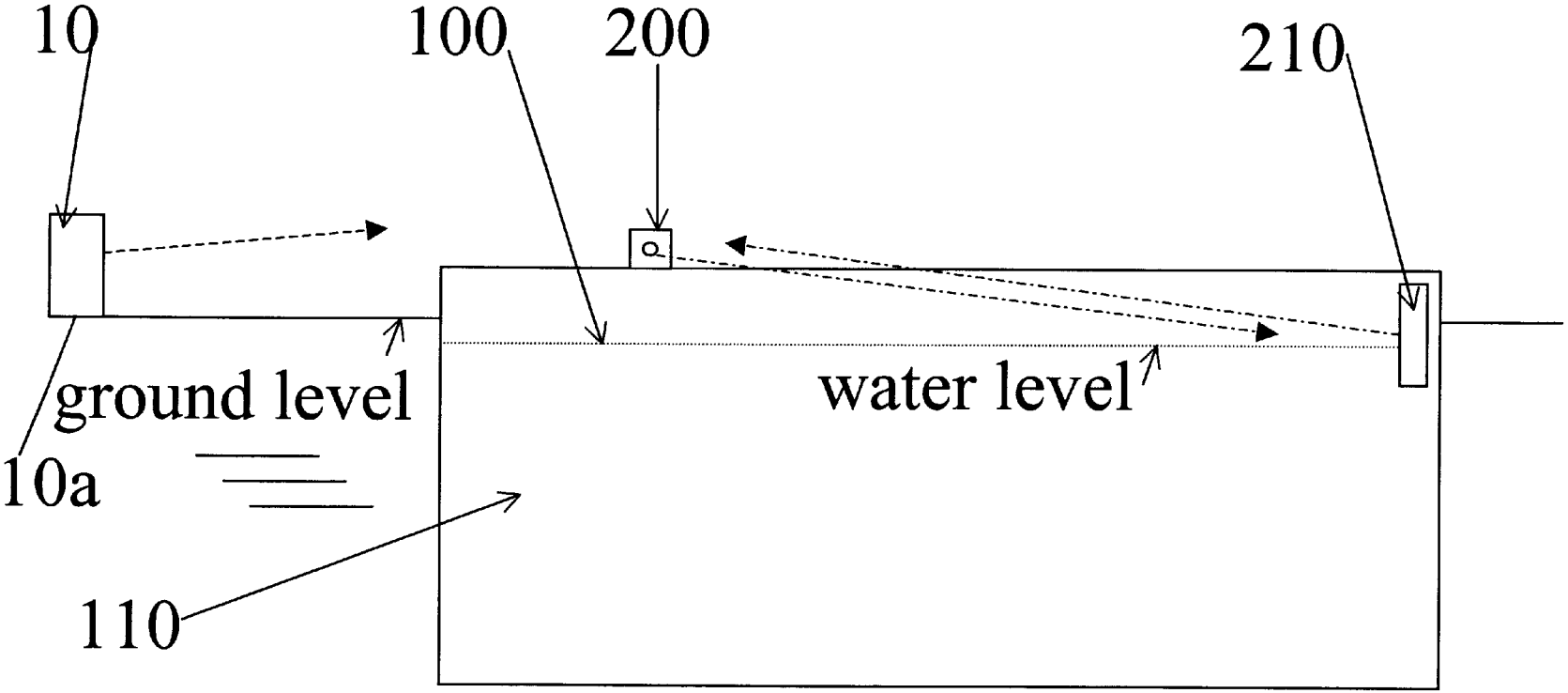
FIG. 3 is a schematic side view diagram showing some illustrative embodiments of the invention.

In the embodiment shown in FIG. 3, a sensor device includes two portions, a transmitter/receiver device 200 (mounted proximate the body of water) and a passive reflector/visible device 210. The transmitter/receiver device can discern depth of water level by qualities of the reflected signal (e.g., which may be facilitated through use of a device 210). As a result, a transmission signal can be sent from the device 200 to cause the discharge unit 10 to replenish water, as required, at a corresponding amount and/or rate.

Figure 4:
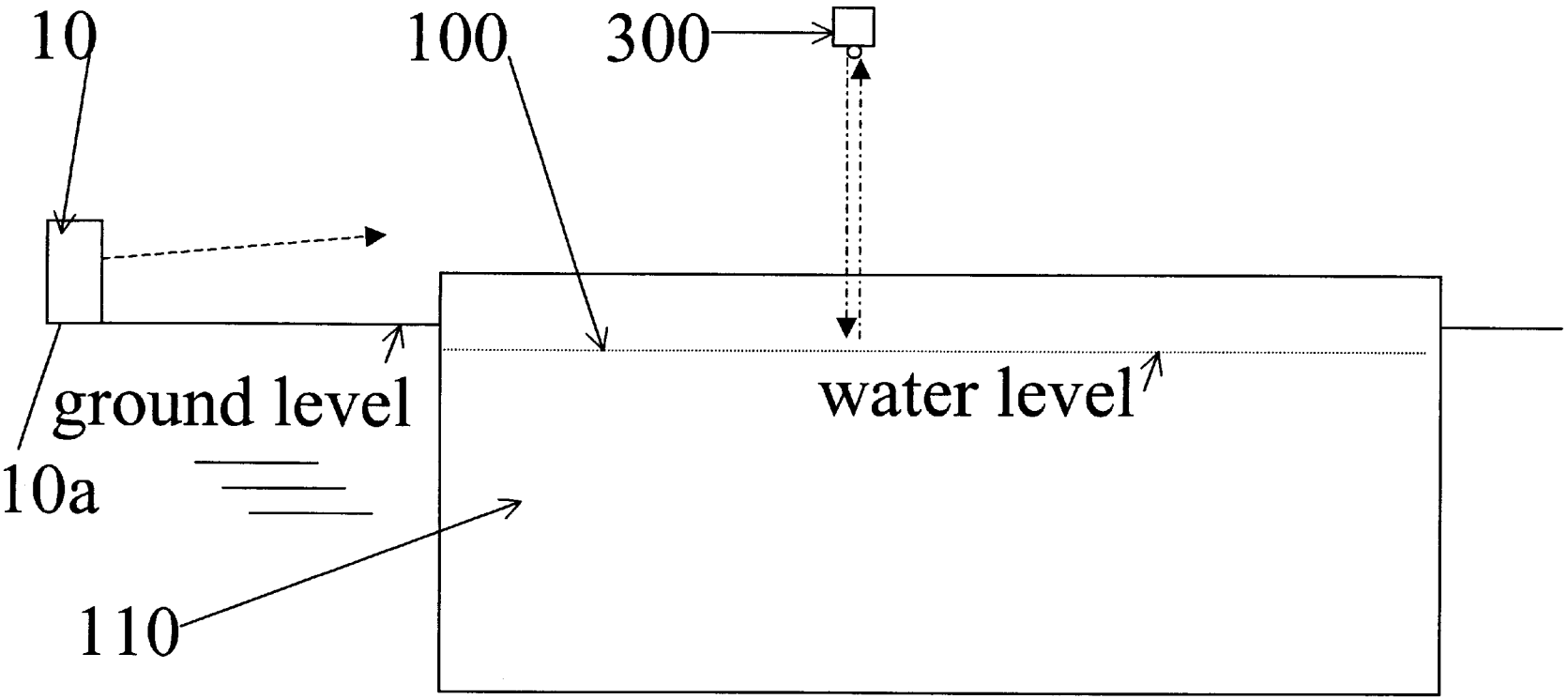
FIG. 4 is another schematic side view diagram showing some illustrative embodiments of the invention.

In other embodiments, as shown in FIG. 4, various water level sensors 300 may be employed that are or may become known, such as radar sensors, ultrasonic sensors and the like. In some embodiments, these sensors may include transmitters and receivers to emit pulses and to receive reflected pulses to determine distances from the water surface (e.g., in a manner similar to that employed in nature by a bat and/or a dolphin using their sonic locating abilities). In some illustrative and non-limiting embodiments, one or more of the following sensors may be employed: the RL329 RADAR sensor by OTT HYDROMETRY; the ECOTONE capacitance water level monitoring system; the DACOM TECHNOLOGIES PULL system (i.e., portable ultrasonic water level logger system); certain sensor products sold by INTERMOUNTAIN ENVIRONMENTAL, INC., including Radar Level Sensor (Cat. No. RL329); Precision Sonic Distance Sensor (Cat. No. SD50); (CSI P/N: SR50-L); Ultrasonic Distance Sensor (Cat. No. SD71); Ultrasonic Distance Sensor (Cat. No. SD71); Ultrasonic Distance Sensor (Cat. No. SD100). In many such embodiments, the sensor can preferably be displaced from the surface of the body of water without any elements placed within or proximate the body of water. In that manner, a depth of a pool or body of water can be accurately monitored without having to place unsightly items and/or obstructive items at, near or inside the body of water (e.g., such as a pool or the like).

Figure 5:
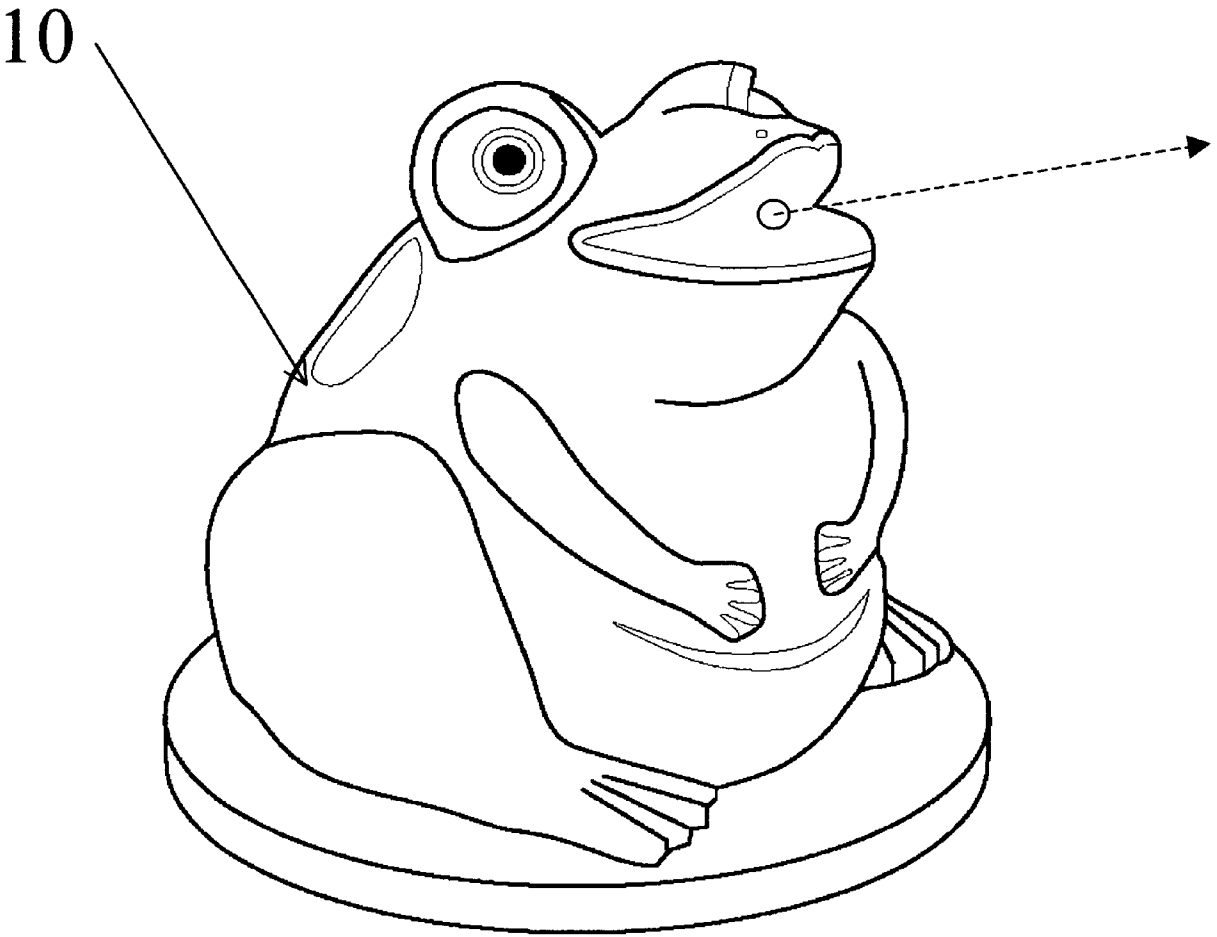
FIG. 5 is a perspective view of a discharge unit according to some preferred embodiments of the invention.

In preferred embodiments, as shown in FIGS. 5 and 6, the discharge unit 10 is preferably configured to resemble an article of nature and, most preferably, an animal. Most preferably, the discharge unit 10 is configured to resemble an aquatic animal such as an amphibian (e.g., frog, salamander, etc.), a fish, a dolphin, whale, or the like. However, the discharge unit can alternatively be configured as any animal that is germane to that locality or region (e.g., a rabbit, squirrel, etc.) or as any other animal, object or item. In some preferred embodiments, the discharge unit will include a molded plastic or polymer shell. In other preferred embodiments, the discharge unit with be made with a ceramic material. In other preferred embodiments, other materials can be used to construct a shell for the discharge unit, including, e.g., aluminum, brass, stainless steel, wood and other materials.

In preferred embodiments, the system can readily be adapted to existing bodies of water (e.g., existing pools and the like) without any significant reconstruction of the existing pool or pool site. Accordingly, the system preferably avoids the need for any new conduits or piping to be directed into the body of water or pool. For instance, the lateral displacement of water directed to the body of water (which, most preferably, occurs substantially above-ground so as to keep the area in the region h substantially dry during replenishment) facilitates placement of the discharge away from the body of water and does not require substantial reconstruction. Moreover, embodiments utilizing water level sensors that may be located away from the pool and/or that may include electronic devices located away from the pool can, thus, be simpler to install and remain free from damage by users of the pool or other body of water. Notably, in some embodiments, all or substantially all electronic devices related to the system may be located distally from the environment of the pool users in normal operation in some preferred embodiments of the invention.

In most preferred embodiments of the invention, the present invention is utilized to replenish water loss due to evaporation and/or leakage rather than to replenish water temporarily removed via piping for re-circulation back to the water supply and/or in contrast to active water removed for other purposes. Water loss due to evaporation and/or leakage or the like may often occur at a relatively slow rate and/or may often occur at a relatively inconsistent rate. Among other things, some preferred embodiments of the present invention contemplate that water replenishment using the discharge unit of the present invention will not typically occur for a prolonged period of time (e.g., throughout the day or during the entire run time of the water circulation system of the water body (e.g., the filtration system or conditioning system or the like). On the other hand, in preferred embodiments, the discharge unit can be employed to periodically spray water into the body of water. In some embodiments, the discharge device can be operated so as to replenish water during non-use hours (e.g., during nighttime hours of operation). Alternatively, the discharge device can be operated to spray small amounts of water during increments during the day, such as for a decorative effect during normal operation. In some preferred embodiments, the discharge device will spray water directly into the body of water in a generally streamlike manner—e.g., using a generally constant cross-sectional flow and/or generally laminar flow in some embodiments. In some non-limiting illustrative embodiments, the amount of water replenishment can be, for example, about 10–100 gallons per day (e.g., in the environment of an illustrative typical pool of, e.g., about 600 square feet to 2500 square feet of surface area). In some non-limiting illustrative embodiments, the amount of water replenishment can correspond approximately (e.g., plus or minus about 25% or less or preferably plus or minus 10% or less) the estimated evaporation rate loss equation provided in the ASHRAE Applications Handbook.

$$W = \frac{(68.3 + 32.0xV)(P_w - P_a)}{Y}$$

Where:

W—evaporation rate, Lb/Hr-Ft$^2$

V—air velocity over water surface, MPH

Pw—saturation vapor pressure at the water temperature, in. Hg

Pa—saturation vapor pressure at the air dewpoint, in. Hg

Y—Latent heat at pool temperature, Btu/lb

In other some non-limiting illustrative embodiments, water replenishment can be, for example, at a rate of about plus or minus 25% or preferably plus or minus 10% the estimated rates published by the Department of Energy, RSPEC, as set forth below.

Evaporation Rates—Quiet Pool $$W_Q = \frac{(A_P)(C_1 + C_2 v)}{Y}(P_W - P_{DP})$$

Where:

$W_Q$=evaporation rate of water, lb/hr.

$A_P$=area of pool surface, ft$^2$.

$C_1$=69.4 BTU/(h·ft$^2$)·in.Hg.

$C_2$=30.8 BTU/(h·ft$^2$)·in.Hg.

v=air velocity over water surface, MPH.

Y=latent heat required to change water vapor at surface water temperature, BTU/lb $P_{DP}$=saturation pressure at room air dewpoint, in.Hg.

$P_W$=saturation vapor pressure taken at the surface water temperature, in.Hg.

Evaporation Rates—Active Pool $$W_A = W_Q \times AF$$

Where:

$W_A$=evaporation rate of water for an active pool, lb/hr.

$W_Q$=evaporation rate of water for an inactive pool, lb/hr

AF=activity factor

Indoor Pool: AF=1.04+(0.046×C)

Outdoor Pool: AF=1.08+(0.039×C)

Where C=Number of swimmers per 100 square feet of pool area.

In other illustrative and non-limiting embodiments, replenishment can be provided at a rate of about 0.04–0.10 Lbs/Hr-Sq Ft-In Hg, and in other illustrative and non-limiting cases at about 0.05 to 0.09 Lbs/Hr-Sq Ft-In Hg, and in other illustrative and non-limiting cases at about 0.06–0.08 Lbs/Hr-Sq Ft-In Hg.

Various other embodiments can employ a variety of other rates of replenishment as would be understood based on this disclosure. In various embodiments, such rates can vary widely depending on circumstances. Additionally, such rates can be adapted to fill continuously, intermittently, periodically and/or as desired in various embodiments.

In various embodiments, the discharge unit 10 can be utilized additionally, interchangeably or alternatively to irrigate a lawn or landscaped area. For example, the discharge unit 10 can include a sprinkler head (e.g., device to spray a widened area or the like). Among other things, this provides the unit with greater functionality and can provide a decorative means for filling a body of water and/or for watering or irrigating an area. In some preferred embodiments, a preferred business method would include advertising "dual" capabilities of such a device for filling bodies of water and for watering landscaping, lawns, ground surfaces or the like.

In some illustrative an non-limiting embodiments, the discharge device can be located anywhere desired, such as, in some examples, on a concrete patio, in a garden or the like and, if desired, can add aesthetic appeal as a piece of landscaping, a decorative piece or the like which also has functionality for the filling, watering or the like. In some illustrative and non-limiting embodiments, for instance, a discharge device can, e.g., sit about 3–7 feet or more deep into some landscaping surrounded by foliage, and can shoot a clean stream of water in an arc that is at least about 5–10 feet high and at least about 8–12 feet long into the middle of a pool or other body of water. The arrangements, distances, sizes, etc., can vary very widely in various embodiments of the invention.

In some illustrative embodiments, the discharge unit 10 can be used as a generally self-contained product (e.g., attached to a garden hose via a hose spigot), while in some embodiments it can be packaged and/or advertised to be used in conjunction with an existing irrigation system. In some illustrative examples, an irrigation system can be used that concurrently waters a lawn or landscaped area along with filling the pool or other body of water utilizing the same timer and/or valve mechanisms and/or water source, etc. In some illustrative examples, the discharge device can run-off an irrigation system for a yard and be connected to a separate lawn sprinkler timer box, such that a timer and/or valve mechanism is not needed nor necessarily used or included certain embodiments.

BROAD SCOPE OF THE INVENTION

While illustrative embodiments of the invention have been described herein, it will be appreciated that the present invention is not limited to the various embodiments described herein, but includes any and all embodiments having modifications, omissions, combinations (e.g., of aspects across various embodiments), adaptations and/or alterations as would be appreciated by those in the art based on the present disclosure. The appended claims are to be interpreted broadly based the language employed in the claims and not improperly limited to illustrative examples described in the present specification or in the prosecution of the application. As merely one example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts are not recited in support of that function.

What is claimed is:

1. A method for maintaining a generally consistent level of water in a depleting body of water, comprising:

a) providing a depleting body of water;

b) providing a discharge unit laterally displaced from said depleting body of water;

c) providing said discharge unit with a water inlet and a water outlet;

d) providing a water conduit extending to said water inlet from a supply source of water;

f) positioning said water outlet so as to transmit water in an above-ground trajectory laterally into said depleting body of water;

g) determining a water depletion amount;

h) establishing a water flow through said discharge device and out of said water outlet in said above-ground trajectory into said body of water based on the water depletion amount determined.

2. The method of claim 1, further including providing said body of water as a swimming or wading pool for humans.

3. The method of claim 2, further including providing steps leading down into said water for humans to walk into said body of water.

4. The method of claim 2, further including providing a ladder leading down into said water for humans to climb into said body of water.

5. The method of claim 2, further including providing said pool at least partially above ground.

6. The method of claim 2, further including providing said pool as an in-ground pool.

7. The method of claim 2, further including providing said pool with concrete bottom and side walls.

8. The method of claim 1, further including having said outlet of said discharge unit laterally displaced at least about two feet from said body of water.

9. The method of claim 8, further including having said outlet of said discharge unit laterally displaced at least about four feet from said body of water.

10. The method of claim 8, further including having said outlet of said discharge unit laterally displaced at least about eight feet from said body of water.

11. The method of claim 8, further including having said outlet of said discharge unit laterally displaced at least about ten feet from said body of water.

12. The method of claim 1, further including providing said discharge unit with a base that rests at a level substantially equal to a top of a perimeter wall around said body of water over which water discharged from said discharge unit is discharged.

13. The method of claim 1, further including having said discharge unit discharge water through said outlet at an inclination of between horizontal (90 degrees) and vertical (zero degrees).

14. The method of claim 13, further including having said discharge unit discharge water through said outlet at an inclination of between about 15 degrees and 75 degrees.

15. The method of claim 2, further including providing said pool with a patio area surrounding at least a portion of the pool and having said discharge unit configured to discharge water over said patio area into said pool.

16. The method of claim 15, further including having said patio area configured for walking and substantially free from obstruction from between said discharge unit and said pool such that individuals can freely walk between said discharge unit and said pool along a substantially continuous and substantially flat patio surface.

17. The method of claim 1, further including providing said discharge unit in the shape of an animal.

18. The method of claim 1, further including providing said discharge unit in the shape of a frog, and wherein said water outlet is located in a mouth region of the frog.

19. The method of claim 1, further including having said discharge unit configured in the shape of an article of nature so as to blend in with the landscaping surrounding the body of water.

20. The method of claim 1, further including having said determining water depletion amount include determining water evaporation amount.

21. The method of claim 20, further including having said determining water depletion amount include user observation of water level lowering in the body of water over a period of time.

22. The method of claim 20 further including having said means for determining water depletion amount include a water level sensor that senses a level of water in said body of water for transmitting a signal related thereto.

23. The method of claim 1, further including providing a timer mechanism for opening and closing said valve for a period of time.

24. The method of claim 23, further including providing means for setting said timer mechanism to open and/or close said valve.

25. The method of claim 24, further including having said valve located within said discharge unit.

26. The method of claim 24, further including having said timer mechanism located within said discharge unit.

27. A system for replenishing water depleted from a body of water, comprising:

a) a depleting body of water;

b) a discharge unit laterally displaced from said depleting body of water;

c) said discharge unit having a water inlet and a water outlet;

d) a supply source of water;

e) a water conduit extending to said water inlet from said supply source of water;

f) said water outlet being positioned so as to transmit water in an above-ground trajectory laterally into said depleting body of water;

g) means for determining water depletion amount;

h) a valve for establishing water flow through said discharge device and out of said water outlet in said above-ground trajectory into said body of water at a rate corresponding to water depletion in the body of water.

28. The system of claim 27, wherein said body of water is a swimming or wading pool for humans.

29. The system of claim 28, wherein said body of water includes steps leading down into said water for humans to walk into said body of water.

30. The system of claim 28, wherein said body of water includes a ladder leading down into said water for humans to climb into said body of water.

31. The system of claim 28, wherein said pool is an above ground pool.

32. The system of claim 28, wherein said pool is an in-ground pool.

33. The system of claim 28, wherein said pool has concrete bottom and side walls.

34. The system of claim 27, wherein said outlet of said discharge unit is laterally displaced at least about two feet from said body of water.

35. The system of claim 34, wherein said outlet of said discharge unit is laterally displaced at least about four feet from said body of water.

36. The system of claim 34, wherein said outlet of said discharge unit is laterally displaced at least about eight feet from said body of water.

37. The system of claim 34, wherein said outlet of said discharge unit is laterally displaced at least about ten feet from said body of water.

38. The system of claim 27, wherein said discharge unit has a base that rests at a level substantially equal to a top of a perimeter wall around said body of water over which water discharged from said discharge unit is discharged.

39. The system of claim 27, wherein said discharge unit discharges water through said outlet at an inclination of between horizontal (90 degrees) and vertical (zero degrees).

40. The system of claim 39, wherein said discharge unit discharges water through said outlet at an inclination of between about 15 degrees and 75 degrees.

41. The system of claim 28, wherein said pool has a patio area surrounding at least a portion of the pool and said discharge unit is configured to discharge water over said patio area into said pool.

42. The system of claim 41, wherein said patio area is configured for walking and is substantially free from obstruction from between said discharge unit and said pool such that individuals can freely walk between said discharge unit and said pool along a substantially continuous and substantially flat patio surface.

43. The system of claim 27, wherein said discharge unit is configured in the shape of an animal.

44. The system of claim 27, wherein said discharge unit is configured in the shape of a frog, and wherein said water outlet is located in a mouth region of the frog.

45. The system of claim 27, wherein said discharge unit is configured in the shape of a natural item so as to blend in with the landscaping surrounding the body of water.

46. The system of claim 27, wherein said means for determining water depletion amount includes means for determining water evaporation amount.

47. The system of claim 46, wherein said means for determining water depletion amount includes user observation of water level lowering in the body of water over a period of time.

48. The system of claim 46 wherein said means for determining water depletion amount includes a water level sensor that senses a level of water in said body of water for transmitting a signal related thereto.

49. The system of claim 27, further including a timer mechanism for opening and closing said valve for a period of time.

50. The system of claim 49, further including means for setting said timer mechanism to open and/or close said valve.

51. The system of claim 50, wherein said valve is located within said discharge unit.

52. The system of claim 50, wherein said timer mechanism is located within said discharge unit.

53. The system of claim 27, wherein said body of water is a swimming pool having a maximum depth of at least four feet deep.

54. The system of claim 53, wherein said swimming pool has a maximum depth of at least 9 feet deep.

* * * * *